US005421223A

United States Patent [19]

Wawrzyniak

[11] Patent Number: 5,421,223

[45] Date of Patent: Jun. 6, 1995

[54] OIL FILTER COVER

[76] Inventor: Timothy J. Wawrzyniak, 859 Eleventh, NW., Grand Rapids, Mich. 49504

[21] Appl. No.: 155,995

[22] Filed: Nov. 22, 1993

[51] Int. Cl.[6] ..... B25B 13/06

[52] U.S. Cl. ..... 81/121.1; 81/3.4; 81/64; 7/100

[58] Field of Search ..... 81/3.4, 64, 120, 121.1; 7/100; 185/1.5

[56] References Cited

U.S. PATENT DOCUMENTS

| | | | |
|---|---|---|---|
| 1,131,985 | 3/1915 | Bellois . | |
| 1,952,660 | 3/1934 | Dryden | 81/3.1 |
| 2,746,330 | 5/1956 | Pfetzing | 81/53 |
| 3,043,171 | 12/1960 | Lederer | 81/90 |
| 3,385,141 | 5/1968 | Norman | 81/90 |
| 3,919,901 | 11/1975 | Braman | 81/3.4 |
| 4,020,922 | 5/1977 | Klasel | 184/1.5 |
| 4,177,529 | 12/1979 | Sikula, Jr. | 7/100 |
| 4,266,452 | 5/1981 | Crist | 81/121 |
| 4,376,703 | 3/1983 | Krauss | 210/238 |
| 4,867,017 | 9/1989 | Holman | 81/121.1 |

*Primary Examiner*—James G. Smith
*Attorney, Agent, or Firm*—Price, Heneveld, Cooper, DeWitt & Litton

[57] ABSTRACT

An oil filter cover has a housing with a cylindrical sidewall, an open end, and an opposing closed end. A cavity in the housing extends through the open end and is adapted to receive an oil filter canister. An annular flange circumscribes the open end of the housing and extends inward from the sidewall to partially close around and seal against the oil filter canister. A piercing member extends into the cavity from the closed end to puncture the canister. The piercing member is mounted to a plate which is located in the cavity and abuts the closed end. Further, a series of longitudinal ridges extend into the cavity from the housing sidewall and are spaced circumferentially about the cavity. Each ridge extends at least partially between the open end and the closed end of the housing with some of the ridges extending to abut and hold the piercer mounting plate against the closed end. A protective sleeve is slip-fit over the housing to minimize damage to the cylindrical sidewall from a protruding structure adjacent the oil filter.

28 Claims, 2 Drawing Sheets

OIL FILTER COVER

BACKGROUND OF THE INVENTION

The invention relates to a spill cover for covering and removing a canister which is attached to a larger device, without spilling the contents of the canister. The benefits of the invention may be realized particularly when removing a spin-on type oil filter from an automobile engine or the like.

In the course of removing and replacing an oil filter for an automobile engine or the like, oil commonly drains from the filter or from the filter connector on the engine and spills over the exterior of the filter canister. The oil will typically cover and soil the canister and the hands of the person removing the oil filter and may further drip to the ground or floor. Thus, removing an oil filter is commonly an unpleasant and messy event, and may also create a safety hazard. Being a lubricant, oil covering the exterior of the canister can cause the canister to slip and fall, causing foot or other injury. Also, oil dripping on the floor can cause a person to slip and fall. Thus, minimizing or containing the spill-over of oil when removing an oil filter or the like is clearly desirable.

SUMMARY OF THE INVENTION

An oil filter cover according to the present invention cleverly provides a housing adapted to cover an oil filter canister. The housing has an open end through which the oil filter canister is received. A seal near the open end circumscribes and is adapted to seal with the oil filter canister.

In one aspect of the invention, an annular flange circumscribes the open end of the housing and extends into the open end, defining the seal. In another aspect of the invention, the housing has an inside surface with a series of longitudinal ridges spaced circumferentially about the cavity. Each ridge extends at least partially between the open end and the closed end of the housing.

In further aspects of the invention, the cover includes a sleeve overlaying an outside surface of the housing. The sleeve is a cylindrical member adapted to slide over the housing. The cover further includes a piercing member which extends into the cavity from the closed end. The piercing member is adapted to puncture an oil filter canister and has a shaft portion extending from the closed end to an enlarged head. The head is adapted to puncture the canister and form a puncture opening in the canister which is larger than the shaft of the piercing member. The cover further includes a plate member located in the cavity and abutting the closed end with the piercing member being mounted to and extending from the plate member. The housing and seal are formed in one piece of a resilient, liquid non-permeable, moldable material.

Thus, an oil filter cover according to the present invention provides a convenient tool to cover an oil filter canister, to pierce the canister and drain oil into the cover, and to contain the oil from spilling. These and other features, objects, and benefits of the invention will be recognized by those who practice the invention and by those skilled in the art, from the specification, the claims, and the drawing FIGS.

DESCRIPTION OF THE PREFERRED EMBODIMENTS

Figure 1:
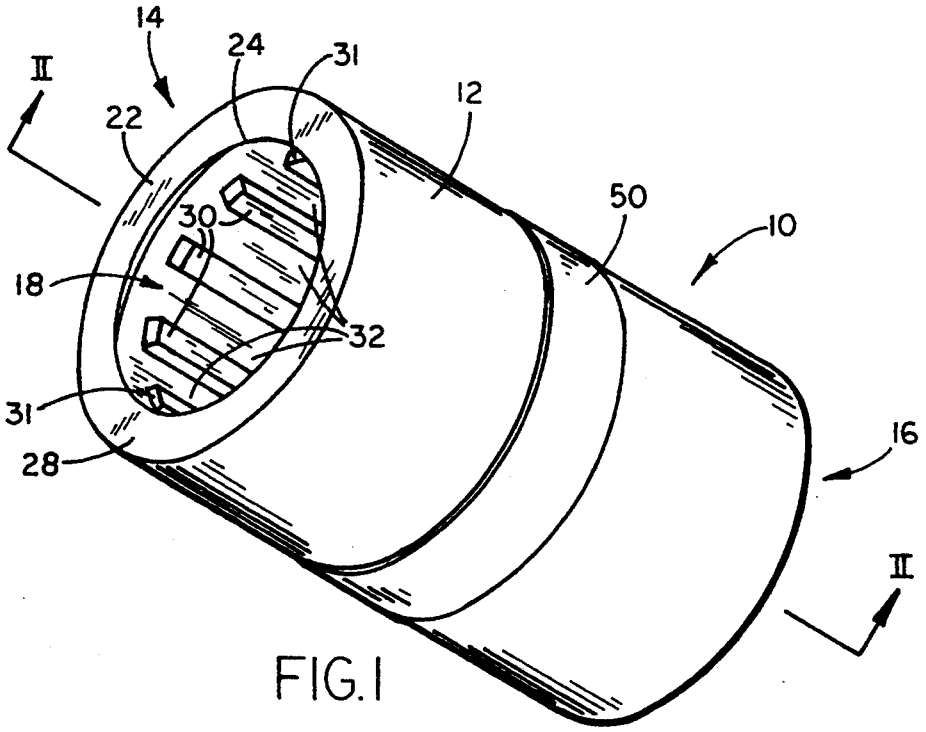
FIG. 1 is a perspective view of an oil filter cover according to the present invention.

An oil filter cover according to the present invention is shown in the drawing FIGS. 1–4 and identified by the reference number 10. Cover 10 is a generally cylindrical device having a housing with a cylindrical sidewall 12, open end 14, and a closed end 16. The housing defines a cavity 18 which extends through open end 14. Cavity 18 is generally cylindrical and proportioned to receive a wide range of oil filter canisters 20 in the manner shown in FIG. 3.

Figure 2:
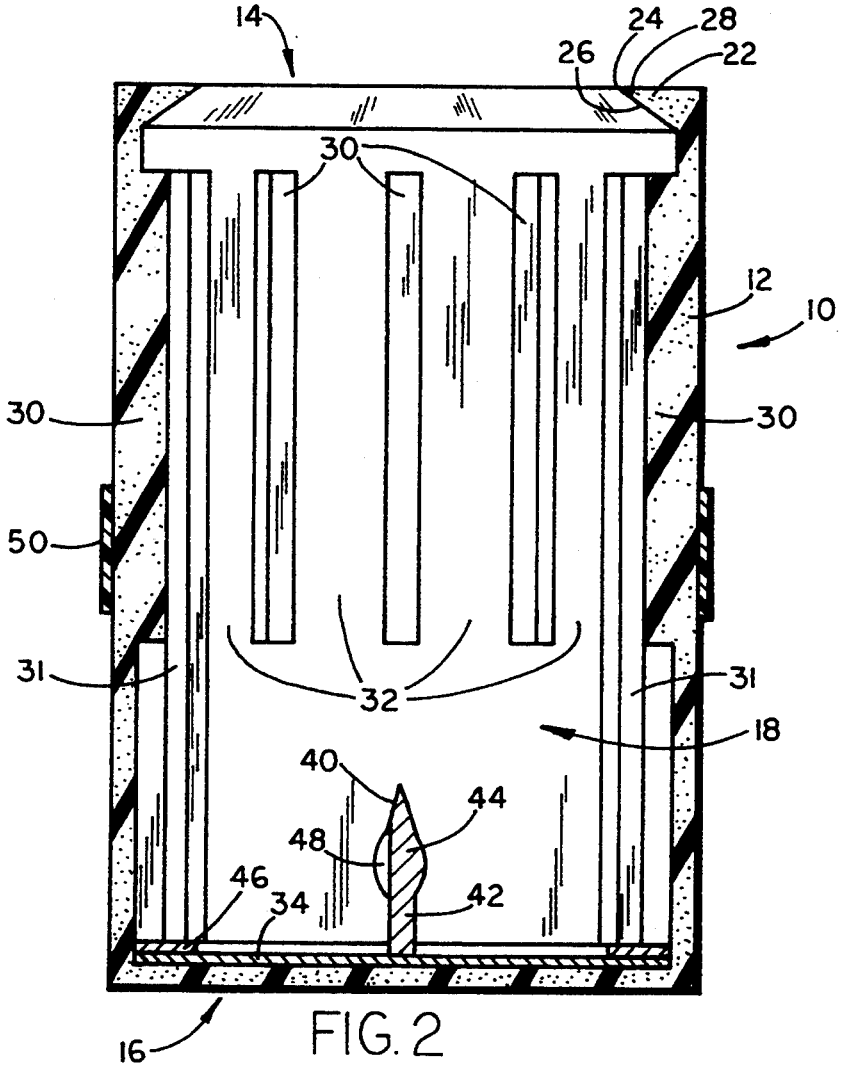
FIG. 2 is a centerline, cross-sectional view of the cover of FIG. 1.
Figure 3:
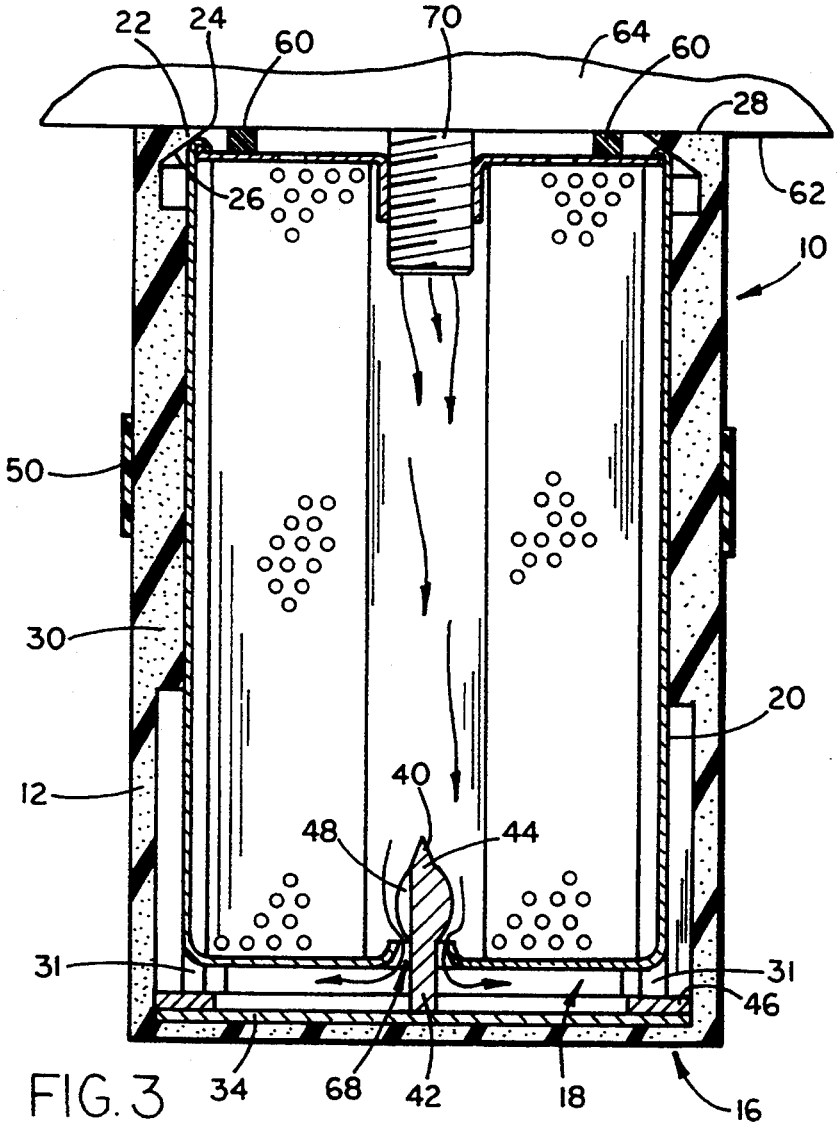
FIG. 3 is the view of FIG. 2 showing the cover installed over an oil filter canister.

An annular flange 22 circumscribes cavity 18 and is most preferably located at open end 14 (FIG. 2). Flange 22 extends inward from sidewall 12 to an edge 24, and has an annular seal surface 26 extending between edge 24 and sidewall 12, and has a second annular seal surface 28 extending outward from edge 24. Seal surface 26 faces into cavity 18, toward closed end 16 and is adapted to seal with canister 20, at an end of the canister (FIG. 3). Seal surface 28 faces generally away from cavity 18 and closed end 16 and is adapted to seal against an oil seat surface 62 as explained in greater detail below.

Figure 4:
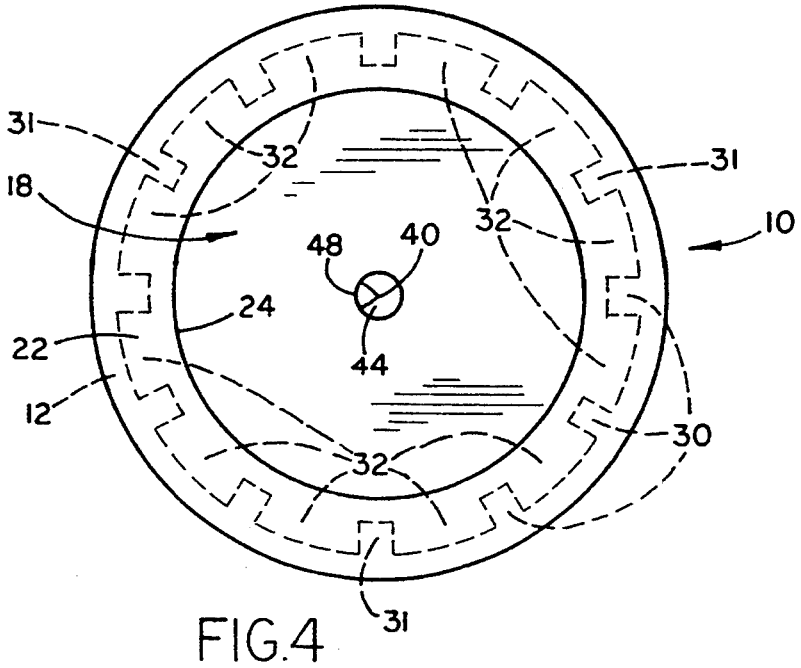
FIG. 4 is an end elevational view of the cover of FIG. 1.

A series of longitudinal ridges 30 extend inward from an inside surface of sidewall 12 (FIGS. 2 and 4). Ridges 30 are spaced circumferentially about cavity 18 and define a series of interspaced valleys 32. Ridges 30 extend at least partially and most preferably about two-thirds the distance between open end 14 and closed end 16. At least some of ridges 30, identified as ridges 31, extend up to, but spaced from, closed end 16 to overlap a plate 34 and hold plate 34 against closed end 16 as discussed further below. Ridges 30 are sized to extend inward from sidewall 12 an amount which provides slip-fit of cover 10 over canister 20, but also provides sufficient frictional contact between ridges 30 and canister 20 to hold cover 10 in place on canister 20 and to provide hand manipulation of canister 20 through cover 10 (FIG. 3).

The cover housing, including sidewall 12, closed end 16, annular flange 22 with edge 24 and annular seal surface 26, and ridges 30, is most preferably formed in one piece of a suitable, resilient, liquid-resistant or non-permeable, moldable material as is commercially known and available. One readily available material which is suitable for forming the cover housing is a closed-cell neoprene rubber, for example.

Cover 10 also includes a piercing member 40 extending into cavity 18 from plate 34 (FIGS. 2 and 3). Piercing member 40 includes a shaft portion 42 which extends from plate 34 to an enlarged, pointed head 44. Head 44 also has a groove 48 extending along a length of piercing member 40. Piercing member 40 is a hardened member, such as hardened steel, for example, and may be welded or screwed or otherwise fastened to plate 34 by any of various well-known and suitable methods. Most preferably, plate 34 is an about 3/32 inch (2.4 mm) thick metal plate, but may also be a stiffened plastic panel for example.

An about 3/32 inch (2.4 mm) thick annular spacing bushing 46 is interposed between plate 34 and the extended ridges 31 to hold plate 34 against closed end 16 and to space plate 34 away from canister 20. Spacing between canister 20 and plate 34 is desirable in use to allow flow of oil from canister 20, as described further below. Spacing bushing 46 may be any suitable material which is resistant to oil contact deterioration, including, metals, neoprene rubber, and some plastics, for example. Spacing bushing 46 may not be required when plate 34 is a stiffened panel. A stiffened plastic panel, for example, may have stiffening ribs or the like projecting toward canister 20 from a plate portion with the ribs also serving the spacing function.

Further, cover 10 may include a protective sleeve 50. Sleeve 50 is a cylindrical protective ring which slips over outside of sidewall 12 to protect sidewall 12 against damage from a protruding structure adjacent canister 20, such as a bolt, for example. Sleeve 50 is a tough, durable, and resilient member, made from any of various commercially available and suitable materials, including, polyethylene plastic, for example.

In practice, when removing an oil filter canister from an automobile engine or the like, canister 20 is initially loosened with a filter wrench or other suitable tool without puncturing the canister, to a point where the oil gasket 60 remains sealed between canister 20 and a planar oil seat surface 62 of the engine block 64, but canister 20 may be further loosened by hand manipulation (FIG. 3). Open end 14 of cover 10 is slid over canister 20 with flange 22 deflecting and deforming. As cover 10 is fully seated over canister 20, piercing member 40 engages and punctures the thin metal housing of canister 20. When piercing member 40 enters canister 20, enlarged head 44 creates and passes through a puncture opening or hole 68 in canister 20, which is larger than shaft 42 so a fluid passage is created between hole 68 and piercing member 40. However, if canister 20 is relatively shorter than the depth of cavity 18, from open end 14 to closed end 16, head 44 may remain positioned in hole 68 and the fluid passage may include groove 48. Further, as cover 10 is seated over canister 20, open end 14 extends beyond canister 20 and flange 22 closes around the end of canister 20 resuming its original shape, with sealing surface 26 abutting canister 20 in liquid-tight engagement and sealing surface 28 abutting oil seat surface 62.

Thus, while piercing member 40 punctures canister 20, sealing surface 26 seals with canister 20, sealing surface 28 abuts surface 26, and oil flows from canister 20 and inside engine block 64, in the vicinity of the filter connection stub 70, and drains into cavity 18 of cover 10, including, valleys 32. The oil flows around head 44 of piercing member 40 and through groove 48 or between shaft 42 and the housing of canister 20, through hole 68. Plate 34 is spaced from canister 20 by spacing bushing 46 or because canister 20 is shorter than cavity 18 is deep, so the oil passage through hole 68 is not blocked by plate 34 abutting against canister 20. Further, the oil is free to flow around canister 20, but contained within cover 10 to fill a fluid reservoir defined by that portion of cavity 18 which is not occupied by canister 20, but remains void between canister 20 and cover 10, including, valleys 32. After a brief time to allow the oil to drain from canister 20 and the small amount of oil contained in engine block 64 in the vicinity of the filter connection stub 70 to drain through filter connection stub 70 and into oil filter canister 20, final removal of canister 20 is easily accomplished by hand manipulation of cover 10 to finish unscrewing canister 20 from filter connection stub 70.

It will be understood by those who practice the invention and by those skilled in the art, that various modifications and improvements may be made to the invention without departing front the spirit of the disclosed concept. The scope of protection afforded is to be determined by the claims and by the breadth of interpretation allowed by law.

The embodiments of the invention in which an exclusive property or privilege is claimed are defined as follows:

1. A cover comprising:

a generally cylindrical housing having an open end and an opposing closed end;

a cavity in said housing, said cavity extending through said open end of said housing, said cavity being adapted to releasably receive a canister in slip-fit engagement; and an annular flange circumscribing said open end of said housing, said flange extending inward from a sidewall of said housing, into said open end, to an edge, said flange having a first annular seal surface extending outward from said edge of said flange on a first side of said flange facing toward said closed end of said housing to seal against the canister in liquid-tight engagement, said flange having a second annular seal surface extending outward from said edge of said flange on a second side of said flange facing away from said closed end to abut a generally planar surface in liquid-tight engagement.

2. The cover defined in claim 1 wherein said housing has an inside surface with a series of longitudinal ridges spaced circumferentially about said cavity, each said ridge extending at least partially between said open end and said closed end of said housing.

3. The cover defined in claim 1 wherein said cover further includes a sleeve overlaying an outside surface of said housing.

4. The cover defined in claim 3 wherein said sleeve is a cylindrical member adapted to slide over said housing.

5. The cover defined in claim 4 wherein said cover further includes a piercing member extending into said cavity from said closed end, said piercing member being adapted to puncture the canister.

6. The cover defined in claim 5 wherein said piercing member has a shaft portion extending from said closed end to an enlarged head, said head being adapted to puncture the canister and form a puncture opening in the canister, which is larger than said shaft.

7. The cover defined in claim 6 wherein said cover further includes a plate member located in said cavity and abutting said closed end, and wherein said piercing member is mounted to said plate member.

8. The cover defined in claim 7 wherein said cover further includes means for holding said plate against said closed end.

9. The cover defined in claim 8 wherein said housing, said annular flange, said annular seal, and said series of longitudinal ridges are formed in one piece of a resilient, liquid non-permeable, moldable material.

10. The cover defined in claim 2 wherein said housing, said annular flange, said annular seal, and said series of longitudinal ridges are formed in one piece of a resilient, liquid non-permeable, moldable material.

11. The cover defined in claim 10 wherein said cover further includes a piercing member extending into said cavity from said closed end, said piercing member being adapted to puncture the canister.

12. The cover defined in claim 1 wherein said cover further includes a sleeve overlaying an outside surface of said housing.

13. The cover defined in claim 1 wherein said cover further includes a piercing member extending into said cavity from said closed end, said piercing member being adapted to puncture the canister.

14. The cover defined in claim 13 wherein said piercing member has a shaft portion extending from said closed end to an enlarged, pointed head, said head being adapted to puncture the canister and form a puncture opening which is larger than said shaft.

15. An oil filter cover for covering an oil filter canister, the oil filter canister abutting a support surface, the cover comprising:

a housing having a generally cylindrical sidewall, an open end, and an opposing closed end;

a cavity in said housing, extending through said open end, and adapted to receive the oil filter canister in slip-fit engagement;

a first seal surface circumscribing said cavity at said open end, said first seal surface facing generally toward said closed end to seal with the oil filter canister in liquid-tight engagement at an end of the oil filter canister;

a second seal surface circumscribing said cavity at said open end, said second seal surface facing generally away from said closed end to abut and seal with the support surface; and a sleeve overlaying an outside surface of said housing.

16. The cover defined in claim 15 wherein said sleeve is a cylindrical member adapted to slide over said housing.

17. The cover defined in claim 15 wherein said cover further includes a piercing member extending into said cavity from said closed end, said piercing member being adapted to puncture the canister.

18. The cover defined in claim 14 wherein said piercing member has a shaft portion extending from said closed end to an enlarged head, said head being adapted to puncture the canister and form a puncture opening in the canister, which is larger than said shaft.

19. The cover defined in claim 18 wherein said cover further includes a plate member located in said cavity and abutting said closed end, and wherein said piercing member is mounted to said plate member.

20. The cover defined in claim 19 wherein said housing has an inside surface with a series of longitudinal ridges spaced circumferentially about said cavity, each said ridge extending at least partially between said open end and said closed end of said housing.

21. The cover defined in claim 20 wherein said housing, said first seal surface, said second seal surface, and said series of longitudinal ridges are formed in one piece of a resilient, liquid non-permeable, moldable material.

22. The cover defined in claim 15 wherein said housing, said first seal surface, and said second seal surface are formed in one piece of a resilient, liquid non-permeable, moldable material.

23. An oil filter cover comprising:

a housing having a generally cylindrical sidewall, an open end, and an opposing closed end;

a cavity in said housing, said cavity extending through said open end, and being adapted to receive an oil filter canister in slip-fit engagement;

a fluid reservoir in said cavity;

a seal circumscribing said cavity at said open end and being adapted to seal with the oil filter canister in liquid-tight engagement at an end of the oil filter canister, said seal also being adapted to seal with a surface, when the end of the oil filter canister is positioned in closely spaced proximity to the surface, with said seal interposed between the oil filter canister and the surface; and said housing being formed in one piece of a resilient, thermal-insulating, liquid non-permeable moldable material.

24. The cover defined in claim 23 wherein said cover further includes a sleeve overlaying an outside surface of said housing.

25. The cover defined in claim 24 wherein said cover further includes a piercing member extending into said cavity from said closed end, said piercing member being adapted to puncture the canister.

26. The cover defined in claim 25 wherein said piercing member has a shaft portion extending from said closed end to an enlarged head, said head being adapted to puncture the canister and form a puncture opening in the canister, which is larger than said shaft.

27. The cover defined in claim 26 wherein said cover further includes a plate member located in said cavity and abutting said closed end, and wherein said piercing member is mounted to said plate member.

28. The cover defined in claim 23 wherein said cover further includes a piercing member extending into said cavity from said closed end, said piercing member being adapted to puncture the canister.

* * * * *

UNITED STATES PATENT AND TRADEMARK OFFICE

CERTIFICATE OF CORRECTION

PATENT NO. : 5,421,223
DATED : June 6, 1995
INVENTOR(S) : Timothy J. Wawrzyniak

It is certified that error appears in the above-indentified patent and that said Letters Patent is hereby corrected as shown below:

Column 4, line 9;
"front" should be --from--.

Column 4, line 42, claim 3;
"claim 1" should be --claim 2--.

Signed and Sealed this

Seventh Day of November, 1995

*Attest:*

*Attesting Officer*

BRUCE LEHMAN

*Commissioner of Patents and Trademarks*